US008086145B2

(12) United States Patent
Ozawa

(10) Patent No.: US 8,086,145 B2
(45) Date of Patent: Dec. 27, 2011

(54) DEVELOPING DEVICE AND IMAGE FORMING APPARATUS USING THE SAME

(75) Inventor: Hideaki Ozawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 288 days.

(21) Appl. No.: 12/557,129

(22) Filed: Sep. 10, 2009

(65) Prior Publication Data

US 2010/0215406 A1 Aug. 26, 2010

(30) Foreign Application Priority Data

Feb. 26, 2009 (JP) ..... P2009-044617

(51) Int. Cl.
*G03G 15/08* (2006.01)
*G03G 15/00* (2006.01)

(52) U.S. Cl. ..... 399/257; 399/81

(58) Field of Classification Search ..... 399/359, 399/358, 257, 120, 81
See application file for complete search history.

(56) References Cited

U.S. PATENT DOCUMENTS

2007/0059044 A1* 3/2007 Preston et al. ..... 399/257
2008/0298866 A1* 12/2008 Matsumoto et al. ..... 399/359

FOREIGN PATENT DOCUMENTS

JP 09-274385 10/1997
JP 2007-102098 4/2007
JP 2007-156355 6/2007

* cited by examiner

*Primary Examiner* — Susan Lee
(74) *Attorney, Agent, or Firm* — Morgan, Lewis & Bockius LLP

(57) ABSTRACT

A developing device includes: a housing that stores a developing agent including toner and a carrier and that is replenished with the toner and the carrier; an agitation conveyance member that rotates the developing agent to thus agitate and convey the developing agent; a developing agent supply member that supplies to a developing area the conveyed developing agent; a first outlet that discharges a superfluous developing agent, which is in excess of first set storage capacity, of the stored developing agent and that is connected to a recovery device for transferring and collecting the superfluous developing agent; a second outlet that discharges an excessive developing agent, which is in excess of second set storage capacity that is larger in amount than the first set storage capacity, of the stored developing agent; a container that stores the excessive developing agent; and a detection unit that detects the stored excessive developing agent.

2 Claims, 10 Drawing Sheets

DEVELOPING DEVICE AND IMAGE FORMING APPARATUS USING THE SAME

CROSS-REFERENCE TO RELATED APPLICATIONS

This application is based on and claims priority under 35 U.S.C. 119 from Japanese Patent Application No. 2009-044617 filed Feb. 26, 2009.

BACKGROUND

1. Technical Field

The present invention relates to a developing device and an image forming apparatus using it.

2. Related Art

In an image forming apparatus utilizing electrophotography, an electrostatic recording scheme, and the like, an image forming apparatus, such as a printer, a copier, and a facsimile, employs a developing device that develops an electrostatic latent image made on an image carrier, such as a photosensitive element, by means of a powdery developing agent. Recently present as the developing device is a developing device that adopts a so-called trickle technique for performing development by use of a developing agent containing toner and a carrier and discharging an excessive developing agent while replenishing the developing agent with toner and a carrier, to thus attempt an increase in the life of a developing agent, and the like. As a result of adoption of the trickle technique, an excessive developing agent discharged out of the developing device is conveyed by a recovery means and collected in a recovery container.

SUMMARY

According to an aspect of the present invention, there is provided a developing device including:

a housing that stores a developing agent including toner and a carrier and that is replenished with the toner and the carrier;

an agitation conveyance member that rotates the developing agent stored in the housing, so as to agitate and convey the developing agent;

a developing agent supply member that supplies to a developing area the developing agent conveyed by the agitation conveyance member while rotating the developing agent;

a first outlet that is connected to a recovery device and that discharges outside of the housing a superfluous developing agent of the developing agent stored in the housing, the recovery device transferring and collecting the discharged superfluous developing agent, wherein the superfluous developing agent is in excess of a first set storage capacity;

a second outlet that discharges outside of the housing an excessive developing agent of the developing agent stored in the housing, wherein the excessive developing agent is in excess of a second set storage capacity that is larger in amount than the first set storage capacity;

a container that stores the excessive developing agent discharged from the second outlet; and a detection unit that detects the excessive developing agent stored in the container.

BRIEF DESCRIPTION OF THE DRAWINGS

Exemplary embodiment of the present invention will he described in detail based on the following figures, wherein.

DETAILED DESCRIPTION

An exemplary embodiment for implementing the present invention (hereinafter called simply "embodiment") is hereunder described by reference to the accompanying drawings.

Figure 1:
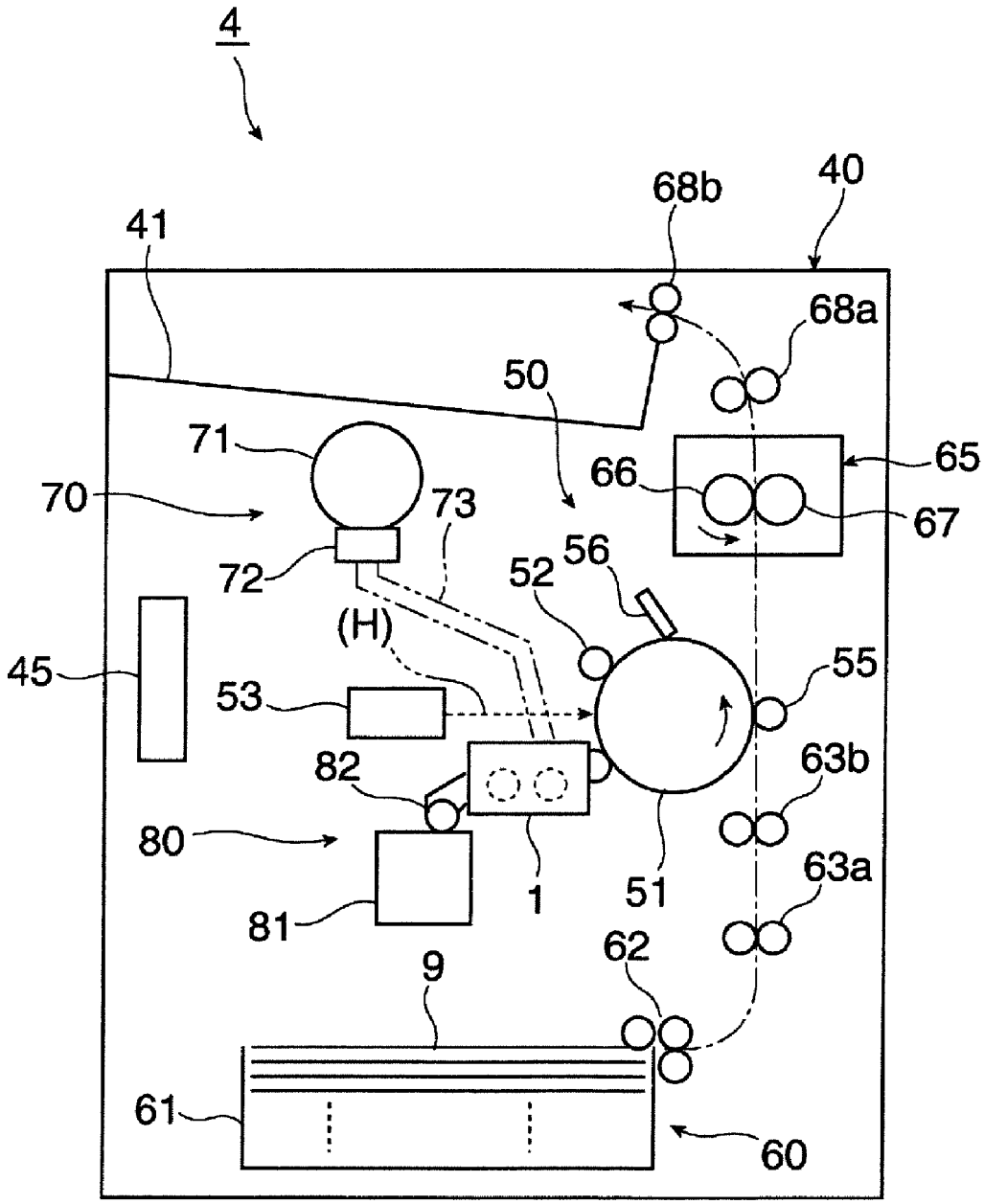
FIG. 1 is a descriptive view showing the general outline of an image forming apparatus and a developing device of an exemplary embodiment of the present invention.
Figure 2:
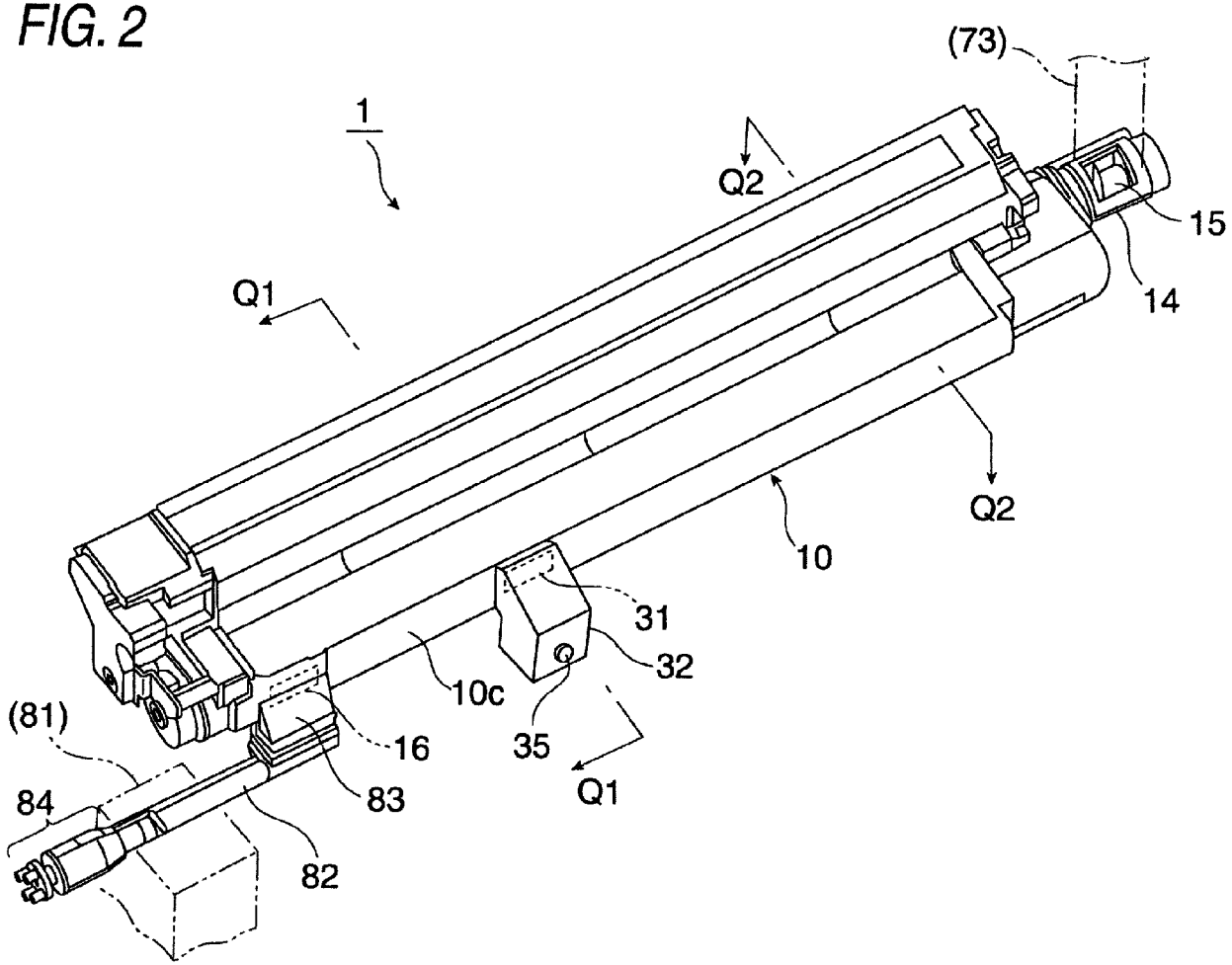
FIG. 2 is a perspective view primarily showing the developing device used in the image forming apparatus shown in FIG. 1.

FIG. 1 shows the principal section of an image forming apparatus 4 to which a developing device 1 of the present invention is applied, and FIG. 2 shows the developing device 1.

First, the image forming apparatus 4 includes the followings disposed within internal space of a housing 40 made up of an unillustrated support member, an exterior cover, and the like. Namely, there are provided an image generator 50 including the developing device 1; a sheet feeder 60 that stores and conveys a required sheet 9 to be supplied to the image generator 50; a replenishment device 70 that conveys replenishes toner T and a carrier C, which make up a developing agent 7, to the developing device 1, thereby replenishing the developing device with the toner and the carrier; a recovery device 80 that conveys and collects a superfluous developing agent 7A output from the developing device 1 as a result of adoption of a trickle technique; and the like.

The image generator 50 is for generating an image from toner of the developing agent 7 by utilization of known electrophotography, and the like; and is primarily built from an electrifier 52 disposed on a photosensitive element 51 that serves an image carrier and that assumes the shape of a drum; an exposure unit 53; the developing device 1; a transfer unit 55; a cleaner 56; and a fixing unit 65 that fixes a toner image to be transferred onto a sheet 9.

The image generator 50 electrifies, by means of the electrifier 52, a circumferential surface of the photosensitive element 51 which is rotationally driven in a direction designated by an arrow (a counterclockwise direction in the exemplary embodiment) and which serves as an image generation area of the photosensitive element 51, to a required electric potential;

and irradiates the thus-electrified circumferential surface of the photosensitive element 51 with light (H), originating from image information (signal), from the exposure unit 53, to thus generate an electrostatic latent image having a potential difference. Subsequently, the image generator 50 develops the electrostatic latent image generated on the photosensitive element 51 by means of toner in the developing agent 7 supplied from the developing device 1, thereby making the electrostatic latent image apparent as a toner image. The toner image is then transferred, by means of the transfer unit 55, to the sheet 9 that is fed from the sheet feeder 60 to a transfer position between the photosensitive element 51 and the transfer unit 55.

In the aforementioned image generation process, an electrifying voltage, a development voltage, or a primary transfer voltage are applied to the electrifier 52, the developing device 1, and a primary transfer unit 65 from an unillustrated power source. After transfer operation, toner, and the like, still remaining on the circumferential surface of the photosensitive element 51 is eliminated by the cleaner 56. The sheet feeder 60 is built from; for instance, a sheet container 61 that is disposed, in a withdrawable manner, in a lower portion of the housing 40 and that is loaded with, in a housing manner, the sheets 9 of required size and type, and the like; a delivery device 62, and the like, that feeds the sheet 9 one at a time from the sheet container 61; and others. The sheet 9 fed out of the sheet feeder 60 is conveyed up to a transfer position by way of plural sheet conveyance roller pairs 63*a* and 63*b* and a sheet conveyance path made up of a conveyance guide member, and the like.

The sheet 9 on which the toner image has been transferred in the image generator 50 is guided to the fixing unit 65 in the image generator 50. The fixing unit 65 is built from a heating rotator 66 and a pressure rotator 67, both of which are arranged in the housing. The heating rotator 66 in the form of a roller, a belt, or the like, is rotationally driven in a direction designated by an arrow, and the surface of the heating rotator is heated to and held at a required temperature by a heating means. The pressure rotator 67 in the form of a roller, a belt, and the like, is rotationally driven by contacting the heating rotator 66, at required pressure, in substantially parallel with an axial direction of the heating rotator 66. In the fixing unit 65, when passing through a contact area between the heating rotator 66 and the pressure rotator 67, the sheet 9 having the transferred toner image undergoes heating and pressure, whereupon the toner image is fused and fixed on the sheet 9.

The sheet 9 having finished being fixed is output from the fixing unit 65 and subsequently conveyed to an output sheet container section 41, and the like, made in a portion (an upper portion) of the housing 40. The sheet 9 output from the fixing unit 65 is conveyed up to the output sheet container section 41, and the like, by way of a sheet conveyance path built from plural sheet conveyance roller pairs 68*a* and 68*b*, a conveyance guide member, and the like. Forming an image on (a single surface) of the sheet 9 is completed through the above processes.

The developing device 1 in the image generator 50 is now described in detail.

As shown in FIGS. 1 through 4, the developing device 1 has a housing 10 serving as an enclosure; a developing roller 20 serving as a developing agent supply member; a layer thickness regulation plate 24 serving as a layer thickness regulation member; and two screw augers 25A and 25B serving as an agitation conveyance member that agitates a developing agent and conveys the thus-agitated developing agent. Reference numeral 7 of FIG. 3, and others, designates (a surface subjected to deposition of) a two-component developing agent including nonmagnetic toner that is fine powder processed in a desired color through coloring, and the like, and a magnetic carrier that correspond to particles for conveying the toner while causing the toner to adhere to the particles. Reference symbol E denotes a developing area around the circumferential surface of the photosensitive element 51 achieved when the developing device 1 performs development.

The housing 10 has a structure including a substantially-rectangular opening 11 and a developing agent storage section 12. The opening 11 is made in an area opposing a developing area E, in the image generator 50, in parallel with the direction of a rotary shaft of the photosensitive element 51. The developing agent storage 12 to serve as internal space for storing the two-component developing agent 7 is made at a position opposing the opening 11. The storage 12 is configured so as to have two parallel circulating conveyance paths 12*a* and 12*b* that are at both ends thereof connected together and partitioned at their centers by a partition wall 13. Communication channels 12*c* and 12*d* for connecting together the two circulating conveyance paths 12*a* and 12*b* are provided at both ends of the partition wall 13. The housing 10 is built while separated into a main body 10A, where the opening 11 and the developing agent storage 12 are made and whose upper portion is opened, and a cover 10B that closes the upper opening of the main body 10A, to thus complete the opening 11 and the developing agent storage 12.

The developing roller 20 is made up of a cylindrical sleeve 21 that is provided in the housing 10 so as to rotate while passing through the opening 11; and a magnet roller 22 that is fixed within the internal space of the sleeve 21. The developing device 1 is disposed in a state where (the sleeve 21 of) the developing roller 20 is spaced a required interval, in a non-contacting manner, apart from the circumferential surface of the photosensitive element 51 that is to serve as the developing area E.

The sleeve 21 of the developing roller 20 is fed with power from an unillustrated rotary drive unit, to thus be rotationally driven in a direction designated by an arrow (a clockwise direction of the exemplary embodiment). Further, as mentioned previously, a development voltage for generating a developing electric field between the sleeve 21 and the photosensitive element 51 is applied to the sleeve from an unillustrated power source. For instance, a d.c. voltage on which an a.c. component is superimposed is applied as the development voltage. The sleeve 21 is made of a nonmagnetic material (e.g., stainless steel aluminum, and the like) in a cylindrical shape whose width (length) is substantially identical with an image forming area of the photosensitive element 51 along the direction of its rotary shaft. Moreover, the sleeve 21 is arranged so as to oppose the photosensitive element 51 while the direction of a rotary shaft of the sleeve is substantially parallel to the direction of the rotary shaft of the photosensitive element 51. The magnet roller 22 is structured in such a way that there are arranged at a predetermined angle plural magnet poles for generating magnetic lines, and the like, which cause the magnetic carrier of the developing agent to magnetically adhere to a circumferential surface of the sleeve 21 by means of required magnetic force.

The layer thickness regulation plate 24 is formed from a nonmagnetic material (e.g., stainless steel) into the shape of a plate that is essentially equal in length to a developing agent holding area on the sleeve 21 in the direction of its rotary shaft. The layer thickness regulation plate 24 is mounted to a portion (an upper portion) of the housing 10 in such a way that an extremity of the layer thickness regulation plate 24 opposes the circumferential surface of (the sleeve 21) of the developing roller 20 with a space for regulating the thickness of the two-component developing agent 7 held on the outer circumferential surface to a required thickness.

Each of the screw augers 25A and 25B is made in such a way that a protruding vane 27 for conveying the two-component developing agent 7 while agitating the same is helically wrapped around the rotary shaft 26 at a predetermined pitch. The augers 25A and 25B are installed respectively in the two circulating conveyance paths 12*a* and 12*b* of the developing agent storage 12 of the housing 10 so as to rotate in a required direction (e.g., a direction designated by arrows of FIG. 3) in which the developing agent 7 located in both conveyance paths may be conveyed in given directions (designated by arrows D1 and D2 of FIG. 4). The respective rotary shafts 26 are at single ends thereof being connected to an unillustrated power transmission, to thus receive rotational power, whereupon the augers 25A and 25B are rotationally driven in the required direction.

Figure 3:
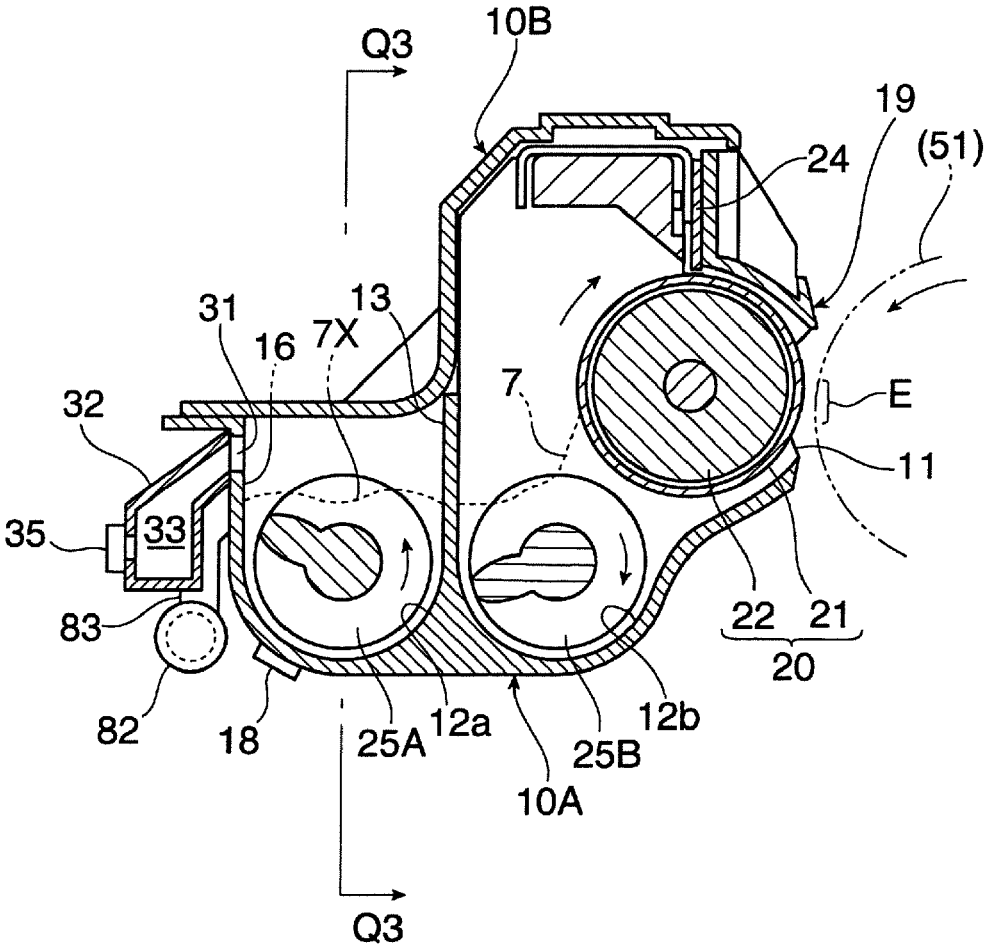
FIG. 3 is a cross-sectional view taken along line Q1-Q1 of the developing device shown in FIG. 2.
Figure 4:
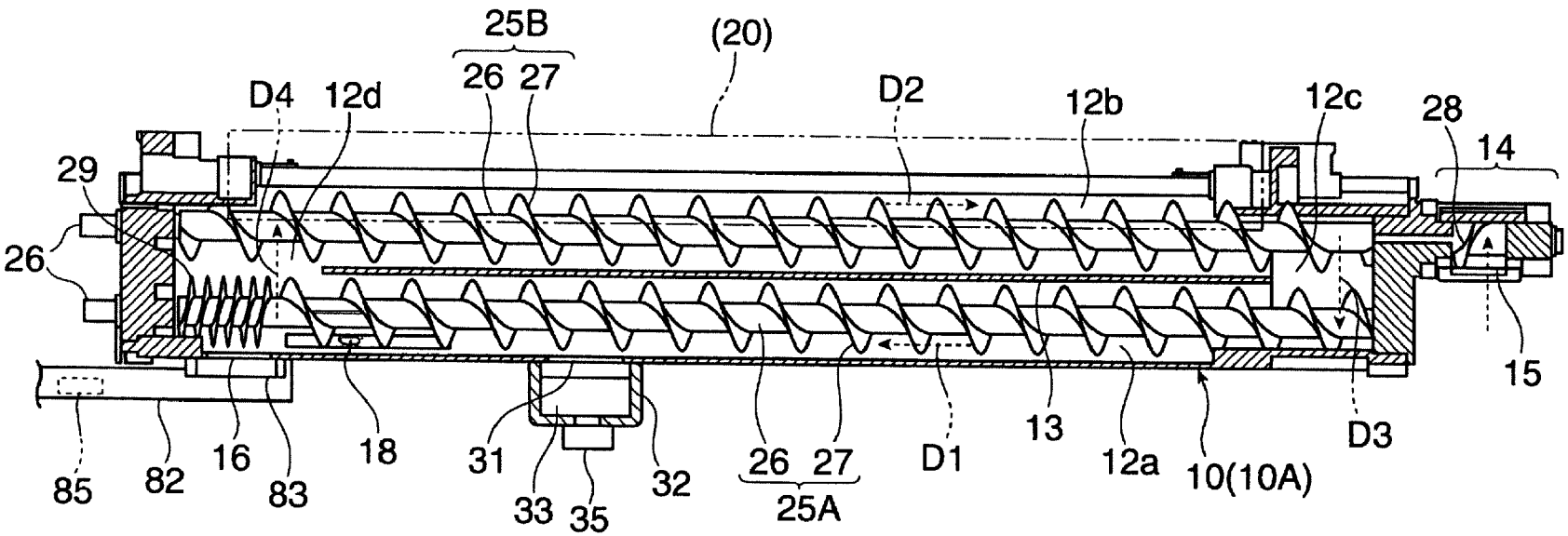
FIG. 4 is a cross-sectional view taken along line Q2-Q2 of the developing device shown in FIG. 2.

Reference numeral 18 of FIGS. 3 and 4 designates a magnetic toner density sensor that detects an amount (density) of toner of the developing agent 7 in the circulating conveyance path 12*a*. Reference numeral 19 of FIG. 3 designates a sealing material that closes clearance between a portion (an upper edge of the opening) of the developing device 1 and the photosensitive element 51.

As shown in FIGS. 2 and 4, the developing device 1 has a replenishment channel 14 for the developing agent 7 that is provided in a portion of the housing 10.

The replenishment channel 14 is made in a cylindrical shape while protruding out of one end of the circulating conveyance path 12*b* in the housing 10 (a portion of the communication channel 12*c*) along an axial direction of the screw auger 25B. The shaft 26 of the auger 25B is disposed in an extended fashion within the replenishment path 14. In relation to an auger disposed in the replenishment path 14, a protruding replenishment conveyance vane 28 that conveys a developing agent in a direction opposite to the conveyance direction D2 of the auger 25B is helically made on the rotary shaft 26. A port 15 for accepting a developing agent conveyed for replenishment from the developing agent replenishment device 70 is made in an upper portion of the replenishment path 14.

As shown in FIG. 1, the replenishment device 70 that conveys a developing agent to replenish the developing device 1 with the developing agent is made up of a toner cartridge 71 that is removably attached to the housing 40 and that serves as a developing agent container for storing the toner T and the carrier C, which are to be replenished, at a required ratio; a replenishment delivery device 72 that accepts the toner and carrier output from the toner cartridge 71 and that delivers at required timing only required amounts of the thus-accepted toner and carrier toward the developing device 1; and a replenishment conveyance pipe 73 that is arranged so as to connect the replenishment delivery device 72 to (the port 15 of) the replenishment path 14 of the developing device 1 and that conveys toner and carrier making up the developing agent 7 delivered from the replenishment delivery device 72.

The replenishment delivery pipe 73 is made up of a pipe-shaped delivery tube and a conveyance rotator that is rotationally provided in a portion or a whole of the delivery pipe and that conveys toner and carrier. For instance, a screw auger, a coiled wire, and the like, is used as the conveyance rotator.

As shown in FIGS. 2 through 4, the developing device I has a trickle outlet 16 that is provided in a part of the housing 10 for discharging a superfluous developing agent 7A generated by the trickle technique.

The trickle outlet 16 is opened in the form of; for instance, a rectangular shape, in a sidewall surface 10*c* making up the communication channel 12*d* that is made at a downstream position in the circulating conveyance path 12*a* of the housing 10 with respect to the conveyance direction D1 of the screw auger 25A. A protruding return vane 29 that conveys the developing agent 7 in a direction opposite to the conveyance direction D1 of the auger 25A is helically made on the end of the rotary shaft 26 of the screw auger 25A corresponding to the area where the outlet 16 is to be made. The return vane 29 is made at; for instance, a helical pitch that is shorter than the helical pitch of the conveyance vane 27 on the auger 25A.

The recovery device 80 that conveys the superfluous developing agent 7A output from (the trickle outlet 16) of the developing device 1, to thus collect the excessive developing agent is made up of a recovery container 81 that finally stores the superfluous developing agent 7A; and a recovery conveyance pipe 82 that is arranged so as to connect the recovery container 81 to the trickle outlet 16 of the developing device 1 and that conveys the superfluous developing agent 7A output from the trickle outlet 16.

The recovery conveyance pipe 82 is made up of a pipe-shaped conveyance tube and a conveyance rotator, such as a screw auger or a coiled wire, which is rotationally provided in a portion or a whole of the delivery pipe and which conveys the developing agent 7A. A joint 83 that is connected and joined to the trickle outlet 16 is provided at one end of the recovery conveyance path 82. A power joint 84 that is joined to transmit rotary power from an unillustrated power transmission to the conveyance rotator is provided at the other end of the recovery conveyance pipe 82. Further, an outlet 85 for discharging the conveyed developing agent 7A toward (the inlet of) the recovery container 81 in a dropping manner is provided in a lower surface of a pipe portion of the recovery conveyance pipe 82 that comes to a position which is more interior to the power joint 84.

As shown in FIGS. 2 through 5, the developing device 1 is provided with an anomaly outlet 31, a container 32, and an anomaly detection sensor 35. The anomaly outlet 31 discharges outside from the housing 10 an excessive developing agent 7B that is greater in amount than storage capacity (first set storage capacity) serving as a measure of storage when a superfluous developing agent 7A of the two-component developing agent 7 stored in the developing agent storage 12 of the housing 10 is discharged. The developing device 1 is also provided with a container 32 that stores the excessive developing agent 7B discharged from the anomaly outlet 31; and the anomaly detection sensor 35 detects the excessive developing agent 7B stored in the container 32.

More specifically, the anomaly outlet 31 is provided so as to discharge (extract) some of the excessive developing agent 7B serving as an amount (second set storage capacity), with reference to the amount of developing agent 7 (the first set storage capacity) stored in the developing agent storage section 12 of the housing 10 in normal timer previously set for a case where the developing agent starts excessively increasing as a result of collection of the superfluous developing agent 7A being not properly performed by the recovery device 80 for any reason. A deposition plane (7X, 7Xa and 7Xb) of the developing agent 7 indicated by a dotted line in FIGS. 5 and 8 designates (a height of) the deposition plane achieved when the amount of developing agent 7 commensurate with set storage capacity employed in normal time is stored. A deposition plane (7Z) of the developing agent 7 indicated by a two-dot chain line in FIGS. 5 and 8 or a dotted line in FIG. 9 designates (the height of) a deposition plane achieved when the amount of the developing agent 7 substantially equivalent to an amount achieved when an increase has arisen in the amount as a result of the superfluous developing agent 7A being not normally collected (i.e., an amount that is storage capacity for an anomalous time and that is larger than set storage capacity for an ordinary time). The second set storage capacity at which some of the excessive developing agent 7B should be discharged is set to a value that ranges from 1.1 to 1.2 times the first set storage capacity.

Figure 5:
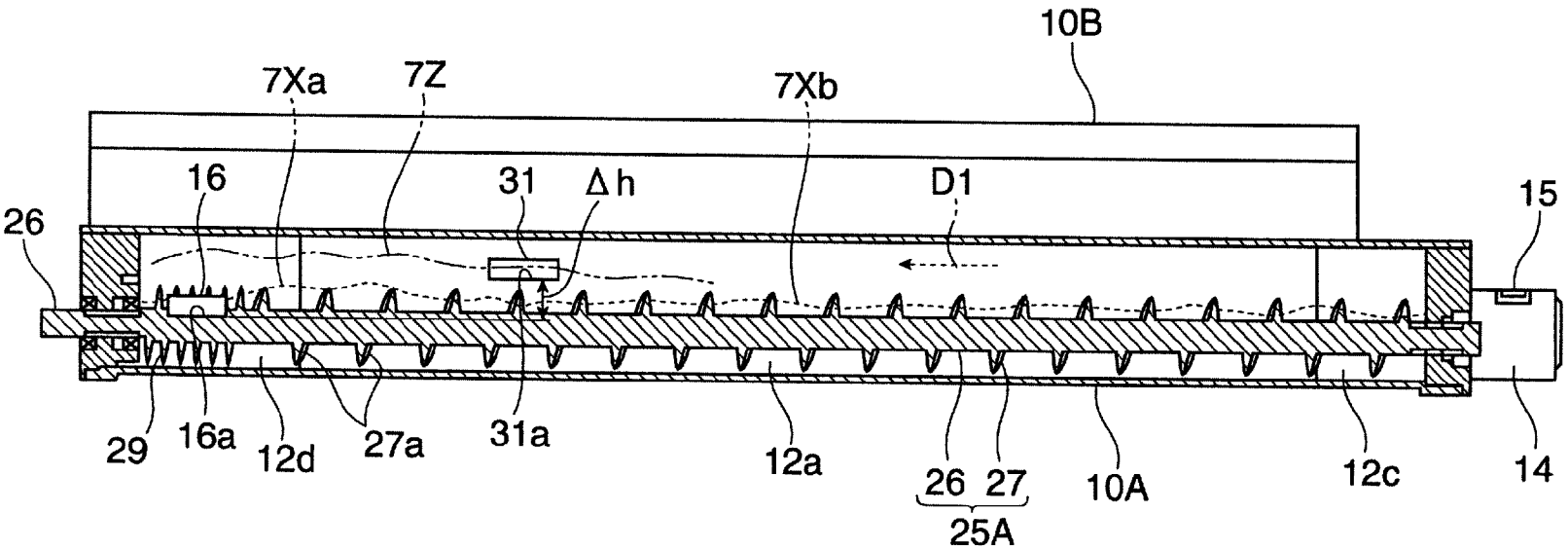
FIG. 5 is a schematic cross-sectional view taken along line Q3-Q3 of the developing device shown in FIG. 3.

In the present exemplary embodiment, the trickle outlet 16 is provided in such a way that an outlet lower side 16*a* comes to a height that is substantially equal to (slightly lower than) an upper portion of the rotary shaft 26 equipped with the return vane 29. At the position of the outlet 16, the deposition plane of the developing agent 7 situated around the return vane 29 becomes slightly lower than the deposition plane of the developing agent 7 situated around the vane 27 of the auger 25A as a result of some of the developing agent 7 being conveyed so as to return in a direction (an upstream direction) opposite to the conveyance direction D1 by conveyance force of the return vane 29; hence, the possibility of the superfluous developing agent 7A being discharged in amount more than necessary is obviated. In contrast, as shown in FIG. 5, a deposition plane (7Xa) of the developing agent 7 situated around a vane 27*a* close to the return vane 29 becomes higher (bowed) than an average height of a deposition plane (7Xb) of the developing agent 7 situated around the vane 27 (at an upstream position with respect to the conveyance direction D1) other than vanes 27*a* as a result of the developing agent 7 conveyed by the vane 27 of the auger 25A and the developing agent 7 conveyed so as to return by the return vane 29 meeting and colliding against each other.

As shown in FIGS. 2 through 5, the anomaly outlet 31 of the exemplary embodiment is an opening whose entirety assumes; for instance, a rectangular shape. The anomaly outlet 31 is provided, on a sidewall surface 10*c* making up the conveyance path 12*a* of the housing 10, at a position that is offset upstream from the trickle outlet 16 in the conveyance direction D1 of the screw auger 25A, in such a way that an outlet lower side 31*a* becomes higher than the outlet lower side 16*a* of the trickle outlet 16. In this case, the essential requirement is to place the anomaly outlet 31 so as to situate within an area in the conveyance path 12*a* where there is the deposition plane (7Xb) that is an average height of the developing agent 7 and such that the outlet lower side 31*a* becomes higher than the deposition plane (7Xb). As a result, the potential of some of the developing agent 7 being discharged from the outlet 31 in an ordinary time may be avoided. Reference symbol Δh in FIG. 5 designates a difference of elevation between the outlet lower side 16*a* of the trickle outlet and the outlet lower side 31*a* of the anomaly outlet.

As shown in FIG. 3, etc., the container 32 storing the excessive developing agent 7B has a storage (space) 33 where the excessive developing agent 7B to be discharged from the anomaly outlet 31 drops under its own weight and is stored. In the present exemplary embodiment, the container 32 is made as a structure separate from the housing 10. However, the container may also be integrally made as a structure having the storage space 33 in a part of the housing 10.

The anomalous sensor 35 may detect presence of the excessive developing agent 7B accumulated in the storage (space) 33 of the container 32 to a given amount (height) or more. In the present exemplary embodiment, a sensor that reacts as a result of the developing agent 7B accumulated in excess of a predetermined amount pressing a pressure sensing portion as in the case of a piezoelectric sensor is used as the anomaly detection sensor 35.

Figure 6:
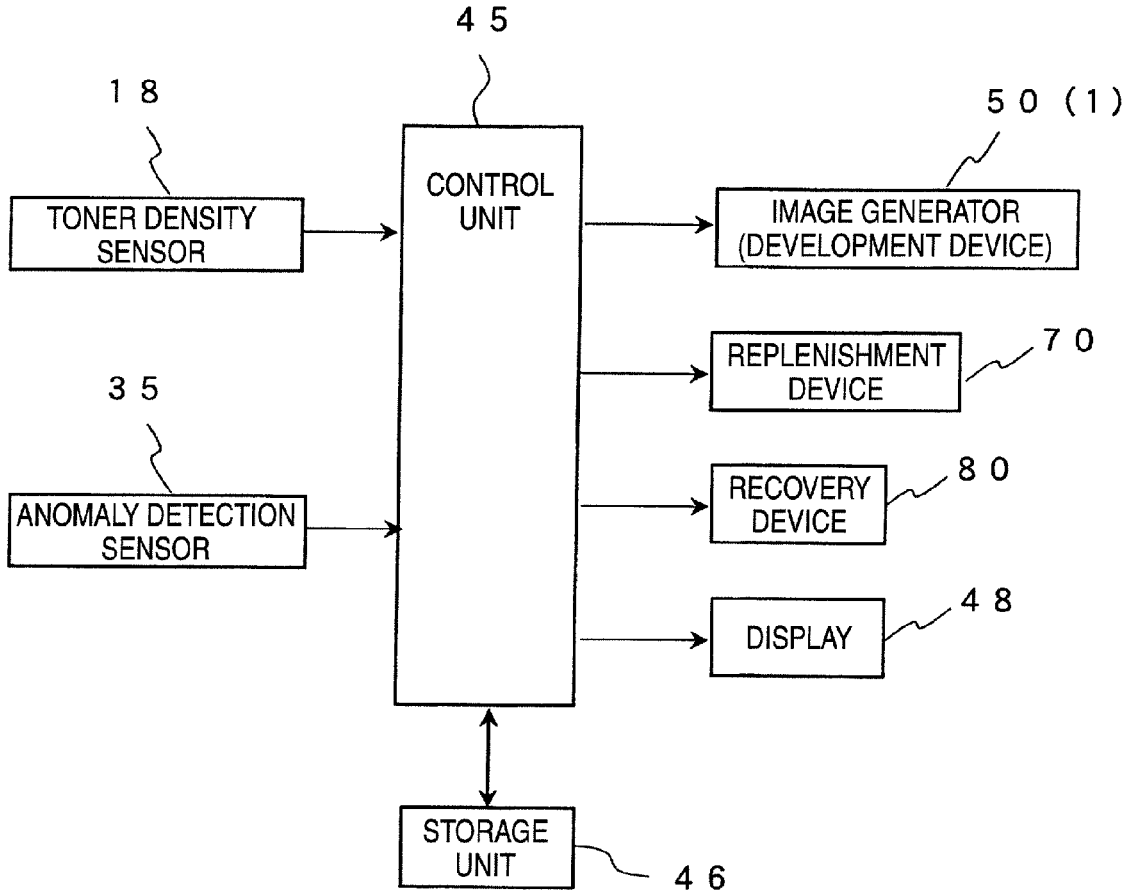
FIG. 6 is a descriptive view showing the principal control configuration of the image forming apparatus.

As shown in FIG. 6, the image forming apparatus 4 to which such a developing device 1 is applied adopts a control configuration relevant to the developing device 1.

Reference numeral 45 in FIG. 6 designates a control unit built from an arithmetic processing unit, a storage means, a controller, and the like. The control unit 45 is connected, as necessary, to a storage unit 46 that serves as an external storage device for storing information about an image generated by the image forming apparatus 4, and the like. The toner density sensor 18 and the anomaly detection sensor 35 of the developing device 1 are connected to the control unit 45, and detection information from the respective sensors is input to the control unit 45. The control unit 45 is also connected to the image generator 50 (including the developing device 1) that is an object of control, the replenishment device 70, and the recovery device 80; and sends a required control signal (information) to the respective control units, thereby controlling operations of the respective devices. In addition, the control unit 45 is connected to a display unit 48 built from a liquid-crystal panel, or the like, which displays a required operating state and a required message; and required information is displayed on the display unit.

Figure 7:
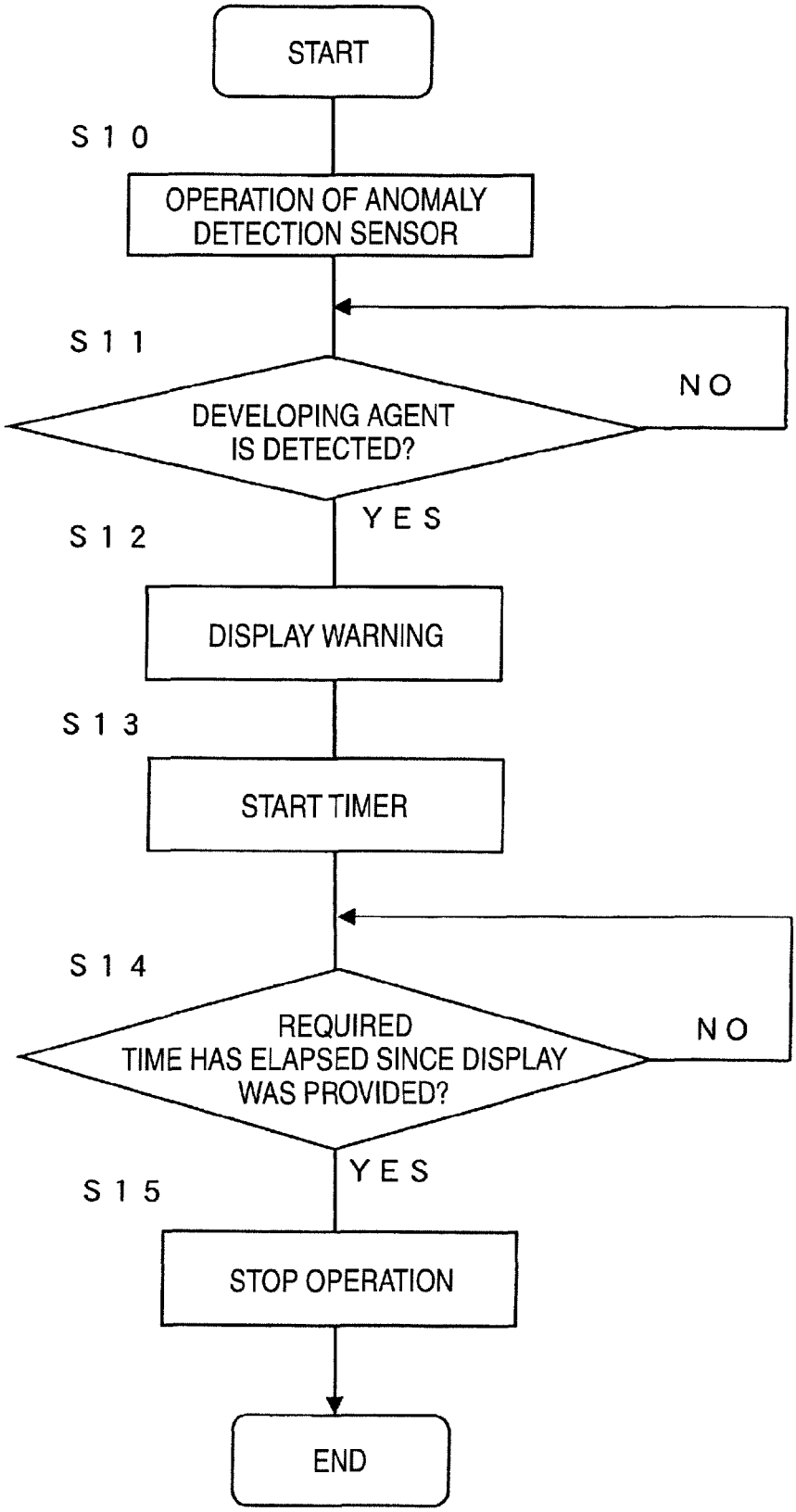
FIG. 7 is a flowchart showing specifics of principal control operation of the developing device and the image forming apparatus.

The control unit 45 performs control operation based on various control programs and data stored in the storage means or the storage unit 46. In particular, the control unit 45 is configured so as to perform control for effecting operation for displaying a warning message pertaining to the recovery device 80 and operation for stopping operating action of the image generator 50 and the recovery device 80 upon acquisition of detection information from the anomaly detection sensor 35 of the developing device 1, as shown in FIG. 7.

Operation of the developing device 1 and operating areas of the image forming apparatus 4 relating to the developing device 1 are hereunder described.

First, when the image forming apparatus 4 performs image forming operation, the developing roller 20 and the screw augers 25A and 25B in the developing device 1 start rotating, and a development voltage is applied to the developing roller 20. The two-component developing agent 7 stored in the developing agent storage 12 of the housing 10 is conveyed in the respective directions of arrows D1 and D2 in the circulating paths 12*a* and 12*b* of the developing agent storage 12 while being agitated by the rotating augers 25A and 25B. Further, the two-component developing agent 7 migrates so as to flow in directions designated by arrows D3 and D4 by way of the communication channels 12*c* and 12*d* through the circulating paths 12*a* and 12*b*. As a result, the two-component developing agent 7 is conveyed in such a state of being circulated as a whole (see FIG. 4). At this time, the toner of the two-component developing agent 7 is sufficiently agitated along with a carrier and thus frictionally electrified, whereby the toner electrostatically adheres to the surface of the carrier.

Subsequently, some of the two-component developing agent 7 conveyed by the auger 25B close to the developing roller 20 is held so as to be attracted by dint of magnetic force of the developing roller 20. Specifically, the developing agent is held on the circumferential surface of the rotating sleeve 21 of the developing roller 20 while making a magnetic brush like an upward ear from plural chains of magnetic carriers to which toner adheres by dint of magnetic force of the magnetic roller 22. Next, the two-component developing agent 7 held on the sleeve 21 undergoes passage control when passing through given clearance made between the sleeve 21 and the layer thickness regulation plate 24 in the course of being conveyed in association with rotation of the sleeve 21, to thus be brought into a substantially-given thickness (the height of the magnetic brush).

The two-component developing agent 7 whose thickness has been regulated as mentioned above is conveyed by rotation of the sleeve 21 of the developing roller 20 to the developing area E where the opening 11 of the housing 10 opposes the photosensitive element 51. The two-component developing agent 7 conveyed to the developing area E is caused to pass while an extremity of the magnetic brush remains in contact with the circumferential surface of the photosensitive element 51. During passage, only the toner of the developing agent 7 is caused to electrostatically adhere to an electrostatic latent image on the photosensitive element 51 by means of a developing (alternating) electric field developed between the developing roller 20 and the photosensitive element 51 from the development voltage applied to the developing roller 20. Thus, the developing device 1 develops the electrostatic latent image.

In the developing device 1, the toner of the developing agent 7 stored in the storage 12 of the housing 10 is consumed and decreased as a result of repetition of development operation in image forming operation, and hence toner and carrier making up the developing agent 7 are supplied from the replenishment device 70. Replenishing operation is performed only at predetermined timing and for a predetermined period of time (in predetermined amount); for instance, when information showing that the toner density of the developing agent 7 is lower than a threshold value is acquired from detection information from the toner density sensor 18.

The replenishment device 70 delivers the toner and carrier discharged from the toner cartridge 71 to the replenishment conveyance pipe 73 by operation of the replenishment conveyance device 72, and further to the developing device 1 by way of the replenishment conveyance pipe 73 (see FIG. 1). When the toner and carrier for replenishing purpose conveyed by way of the replenishment conveyance pipe 73 drop to and are taken in the replenishment conveyance path 14 from the inlet 15 of the developing device 1, the toner and carrier are conveyed to the communication channel 12*c* by dint of conveyance force of the auger 25B where the replenishment conveyance vane 28 is made. Subsequently, the toner and carrier migrate toward the circulating path 12*a* and are taken in, to thus be mixed with the existing developing agent 7 by agitating operation of the auger 25A, and the like (see FIG. 4).

Figure 8:
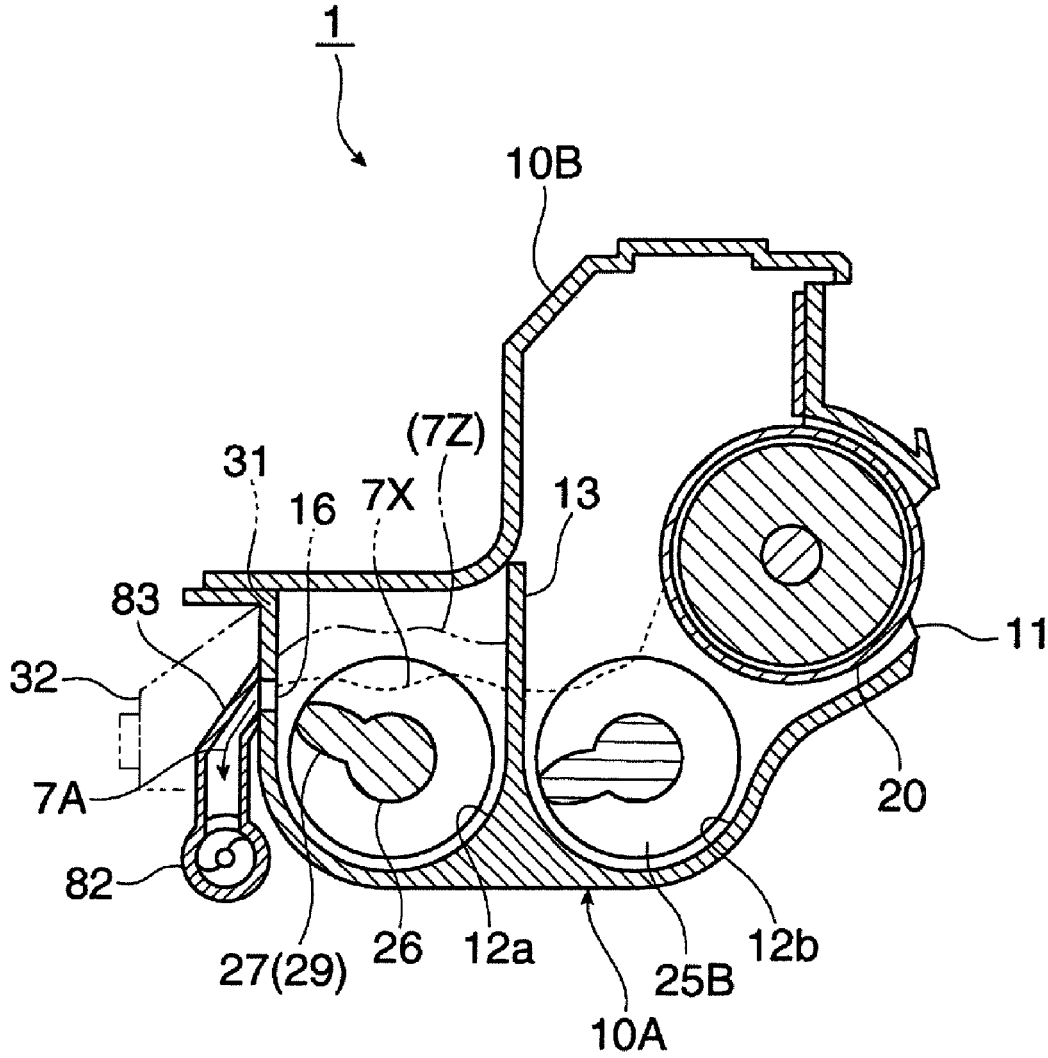
FIG. 8 is a descriptive cross-sectional view showing a state where an excessive developing agent is output and collected by a trickle technique of the developing device.

In the developing device 1, carrier is also replenished by the replenishment device 70 in conjunction with toner by adoption of the trickle technique. Hence, the total amount of developing agent 7 (total storage capacity) stored in the storage 12 of the housing 10 is also increased correspondingly. Some of the thus-increased superfluous developing agent 7A is returned toward the circulating path 12*a* by the return vane 29 through the communication channel 12*d* of the housing 10. Some of the developing agent 7A comes to a position that is higher than the lower side 16*a* of the trickle outlet 16, the developing agent is discharge outside of the housing 10 in a dropping manner by way of the outlet 16 as shown in FIGS. 4 and 8. The superfluous developing agent 7A discharged from the outlet 16 comes to a portion of the developing agent whose amount is in excess of the first set storage capacity and that is smaller than the second set storage capacity.

The superfluous developing agent 7A discharged from the trickle outlet 16 is conveyed and collected by the recovery device 80. Specifically, the discharged superfluous developing agent 7A drops to the main unit of the recovery conveyance pipe 82 by way of the internal space of the joint 83 of the recovery conveyance pipe 82 and is conveyed toward the outlet 85 by means of conveyance force of the conveyance rotator disposed in the conveyance pipe 82. Subsequently, the developing agent 7A is discharged from the outlet 85 so as to finally drop, to thus be stored in the recovery container 81 (see FIGS. 1 and 2).

In the developing device 1, when the superfluous developing agent 7A discharged from the trickle outlet 16 is not properly collected by the recovery device 80 by operation of the trickle technique, the excessive developing agent 7B is not discharged from the trickle outlet 16. A failure of the recovery device 80 to properly perform collection corresponds to; for instance, a case where the conveyance rotator does not rotate within the recovery conveyance pipe 82 or where the conveyance pipe 82 is clogged with the developing agent 7A when the recovery device fails to properly operate as a result of a partial fracture of the recovery device.

When a failure to properly collect the superfluous developing agent 7A is left, the developing device 1 consumes the toner of the developing agent 7 by image-forming (development) operation, whereupon toner and carrier are replenished by the replenishment device 70, to thus generate the superfluous developing agent 7A. Meanwhile, the superfluous developing agent 7A is not discharged from the storage 12 of the housing 10, and hence the amount of developing agent 7 stored in the storage 12 of the housing 10 is anomalously increased.

As shown in FIGS. 5, 8, and the like, the deposition plane 7Z of the developing agent 7 stored in the storage 12 of the housing 10 gradually elevates, to thus become higher in an averaged manner than the deposition plane 7X or 7Xa and 7Xb of the developing agent 7 achieved at storage capacity (the first set storage capacity) for normal time. In particular, in the developing device 1 of the exemplary embodiment, elevation of the deposition plane 7Z of the developing agent first appears noticeably in areas close a boundary between the vane 27 of the auger 25A and the return vane 29 in the communication channel 12*d* of the housing 10 and the communication channel 12*d* of the circulating path 12*a*.

Figure 9:
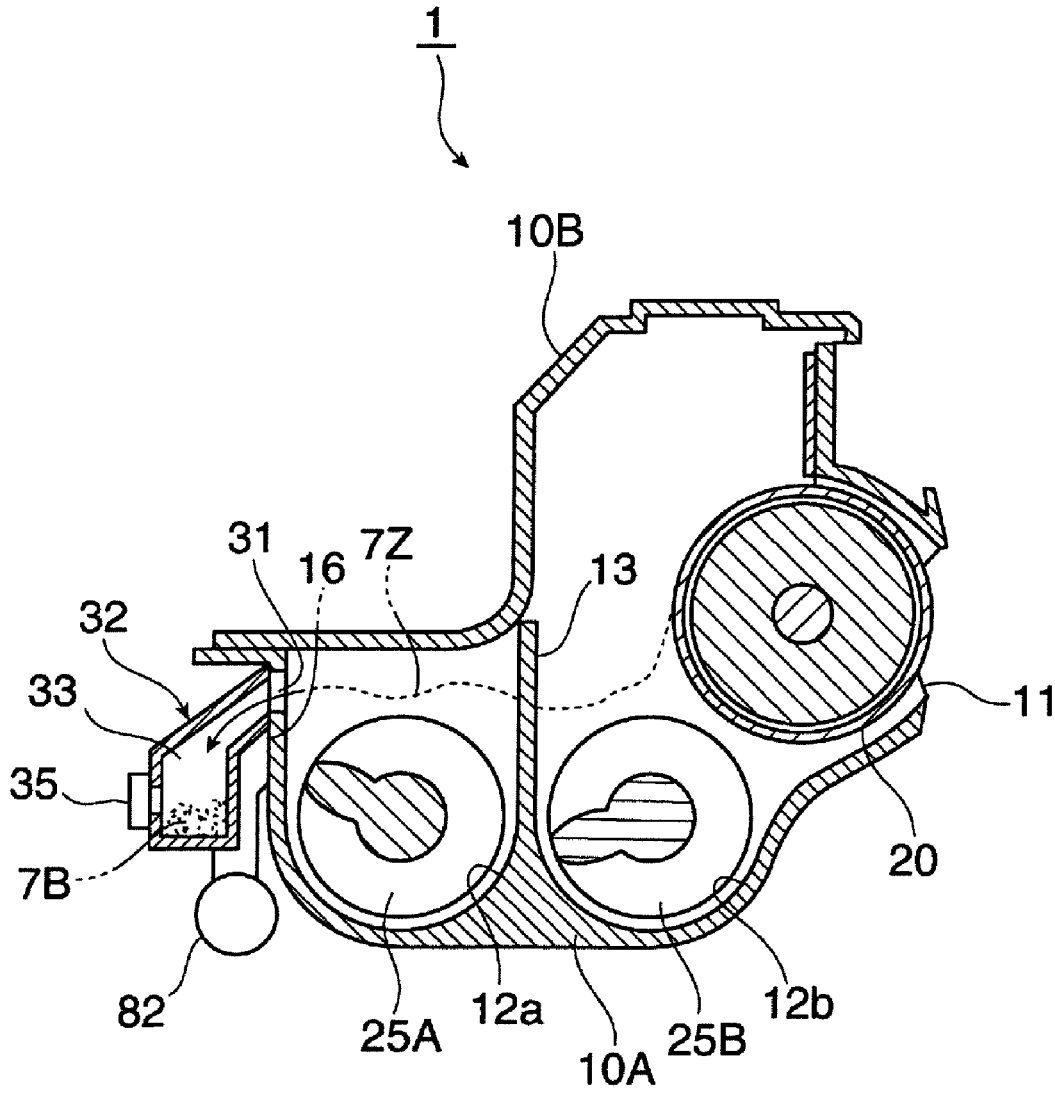
FIG. 9 is a descriptive cross-sectional view showing a state where an excessive developing agent of the developing device is output and detected.

In the developing device 1, when the amount of storage of the developing agent 7 exceeds the second set storage capacity for reasons of an increase induced by a failure to collect the superfluous developing agent 7A as mentioned above, some of the thus-anomalously-increased developing agent starts being discharged from the anomaly outlet 31 as the excessive developing agent 7B, as shown in FIG. 9. In short, the developing agent of the thus-increased developing agent 7 whose height (the deposition plane 7Z) is in excess of the lower side 31*a* of the anomaly outlet 31 starts being discharged from the outlet 31 as the excessive developing agent 7B (see FIG. 5).

As shown in FIG. 9, the excessive developing agent 7B discharged from the anomaly outlet 31 drops to and is stored in the storage space 33 of the container 32 provided while connected to the outlet 31. When the excessive developing agent 7B stored in the container 32 is accumulated to a preset amount, the state of the developing agent is detected by the anomaly detection sensor 35.

Further, (the controller 45 of) the image forming apparatus 4 using the developing device 1 monitors whether or not detection information is acquired from the anomaly detection sensor 35 during at least image forming operation, as shown in FIG. 7 (S10 and S11). When detection information is acquired, a necessary warning message is first displayed on the display 48 (see FIG. 6) (S12). For instance, a warning message stating that the recovery device (80) may be clogged. Please perform checking operation by stopping use of an image forming apparatus, and the like, is displayed as warning.

As a result, in particular, a service engineer may ascertain that recovery of an excessive developing agent is not properly performed by the trickle technique. So long as occurrence of a failure may be ascertained, the service engineer, for instance, does not need to perform laborious operation, such as disassembly of the developing device 1, the recovery device 80, and the like, in order to locate a cause for a failure to collect a superfluous developing agent, and the service engineer may immediately get down to repair the recovery device 80. In particular, when the recovery device 80 is disposed at the rear of the image forming apparatus 4 or when plural developing devices 1 are used, complicate, laborious operation does not need to be wastefully performed for locating the cause.

(The controller 45 of) the image forming apparatus 4 starts a timer when displaying the aforementioned warning, to thus start measuring an elapsed time, thereby managing whether or not a required set time has elapsed since the warning is displayed (S13 and S14). After elapse of the required time, operations of the area of the device relating to image forming operation are forcefully stopped (S15). An object whose operation is to be stopped is at least the image generator 50 and the recovery device 80 including the developing device 1. However, in reality, the object includes other areas of the apparatus relevant to image forming operation; for instance, the sheet feeder 60, the replenishment device 70, and the like. The elapsed time is set to; for instance, an effective time during which a progress arises in a phenomenon of the superfluous developing agent 7A being not properly collected and during which occurrence of a secondary failure attributable to the phenomenon may be prevented.

Thus, occurrence of a new secondary failure, which would otherwise be caused by a trouble of the recovery device 80 failing to properly collect the superfluous developing agent 7A, may be prevented.

Specifically, when a state in which a superfluous developing agent is not properly collected is left (in other words, the image generator 50 and the recovery device 80 are continually operated in that state), failures arise; namely, a failure of some of the anomalously-increased developing agent 7 in the developing device 1 leaking out from clearance in the housing 10, to thus splash outside the housing 10; and a failure of torque for driving the screw augers 25A and 25B being anomalously increased by an anomalous increase in the amount of developing agent 7, to thus impose load on the screw augers. In addition, the toner replenished to the developing device 1 is not well mixed with the existing developing agent 7 for reasons of an anomalous increase in the amount of the developing agent 7. Alternatively, uniform development is not performed in the development process for reasons of insufficient frictional electrification; and an image quality failure attributable to uneven density, and the like, arises in a finally-acquired image. However, occurrence of such a secondary failure may be prevented by forceful stoppage of operation.

Another Exemplary Embodiment

The anomaly outlet 31 in the developing device 1 is not limited to the case where the position and shape of the outlet are illustrated in connection with the exemplary embodiment (see FIG. 5 and others). In reality, the essential requirement is to set the anomaly outlet 31 at an appropriate position and an appropriate state commensurate with a state of an increase in the amount of developing agent 7 (in a precise sense, a state of the deposition plane 7Z of the increased developing agent) in the storage 12 of the housing 10 occurred when collection of the superfluous developing agent is not properly performed.

Figure 10:
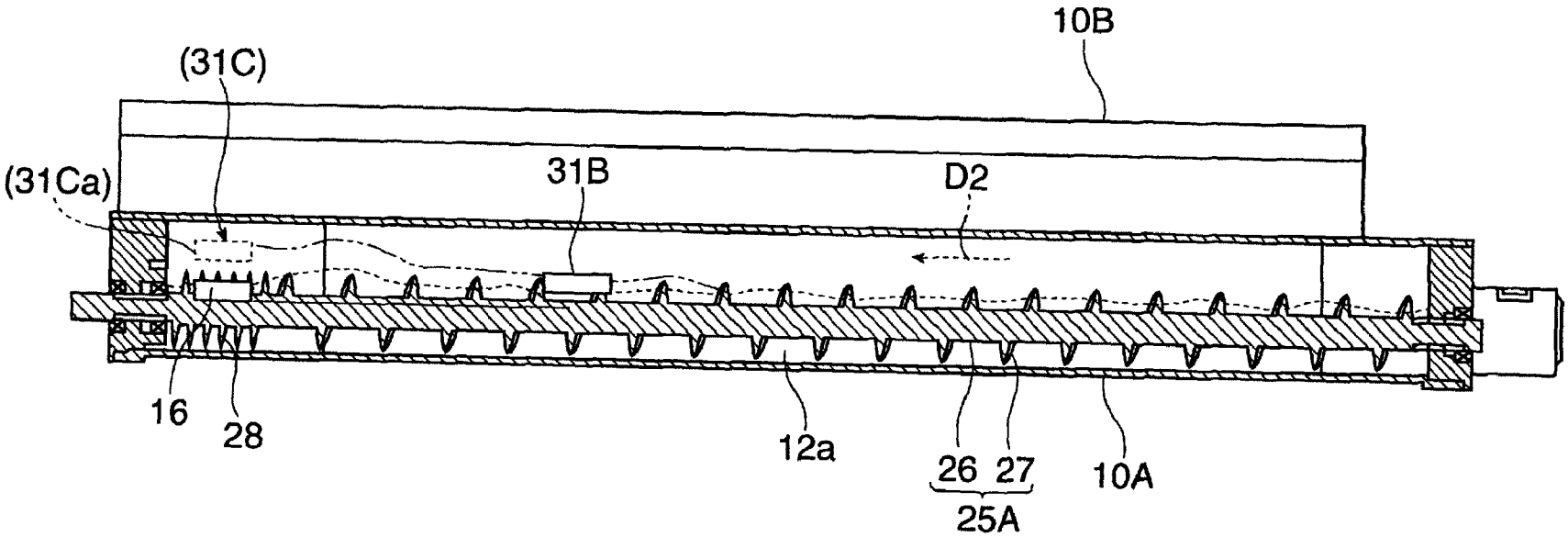
FIG. 10 is a descriptive cross-sectional view showing another example configuration pertaining to a position in the developing device where an anomaly outlet is to be made.

As shown in; for instance, FIG. 10, another example configuration is an anomaly outlet 31B whose outlet lower side 31*a* is provided at substantially the same height as that of the outlet lower side 16*a* of the trickle outlet 16 (the height at which the lower side 31*a* is situated between upper and lower sides of the trickle outlet 16) when the anomaly outlet is provided at a position displaced upstream of the trickle outlet 16 in the conveyance direction D1 of the screw auger 25A. Further, as indicated by a dotted line in the drawing, the anomaly outlet is an anomaly outlet 31C that is provided not at a position displaced from the trickle outlet 16 but at substantially the same location as the position of the trickle outlet in the conveyance direction D1 of the auger 25A. In the anomaly outlet 31C, a lower side 31Ca is preferably formed so as to situate at a position higher than the upper side of the trickle outlet 16.

The image forming apparatus 4 of the exemplary embodiment adopts the configuration in which there is performed control operation for stopping operations of required areas of the apparatus after elapse of a required time since the anomaly detection sensor 35 detected the developing agent and displayed a warning message (see steps S12 to S15 in FIG. 7). No problem will arise even when control is performed so as to display only a warning message (S12) or stop operation of the required areas of the apparatus immediately when the anomaly detection sensor 35 detects a developing agent.

In the exemplary embodiment, there is illustrated the case of the image forming apparatus 4 that uses one developing device 1. However, an image forming apparatus may also use plural developing devices 1. In that case, each of the developing devices 1 is provided with a conveyance pipe 82 of the recovery device 80; and each of the developing devices is provided with the anomaly outlet 31, the container 32, and the anomaly detection sensor 35. In addition, an image generator adopting an intermediate transfer mode that employs a belt-shaped or drum-shaped intermediate transfer element may also be used as the image generator 50 in the image forming apparatus 4.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A developing device comprising:

a housing that stores a developing agent including toner and a carrier and that is replenished with the toner and the carrier;

an agitation conveyance member that rotates the developing agent stored in the housing, so as to agitate and convey the developing agent;

a developing agent supply member that supplies to a developing area the developing agent conveyed by the agitation conveyance member while rotating the developing agent;

a first outlet that is connected to a recovery device and that discharges outside of the housing a superfluous developing agent of the developing agent stored in the housing, the recovery device transferring and collecting the discharged superfluous developing agent, wherein the superfluous developing agent is in excess of a first set storage capacity;

a second outlet that discharges outside of the housing an excessive developing agent of the developing agent stored in the housing, wherein the excessive developing agent is in excess of a second set storage capacity that is larger in amount than the first set storage capacity;

a container that stores the excessive developing agent discharged from the second outlet; and a detection unit that detects the excessive developing agent stored in the container.

2. An image forming apparatus comprising:

a developing device;

an image generator that generates an electrostatic latent image on an image carrier and that develops the electrostatic latent image by using a developing agent supplied from the developing device, so as to generate an image;

a replenishment device that replenishes the developing device with the developing agent; and a recovery device that conveys and collects a part of the developing agent discharged from the developing device, wherein the developing device has:

a housing that stores the developing agent including toner and a carrier and that is replenished with the toner and the carrier by the replenishment device;

an agitation conveyance member that rotates the developing agent stored in the housing, so as to agitate and convey the developing agent;

a developing agent supply member that supplies to a developing area the developing agent conveyed by the agitation conveyance member while rotating the developing agent;

a first outlet that is connected to a recovery device and that discharges outside of the housing a superfluous developing agent of the developing agent stored in the housing, the recovery device transferring and collecting the discharged superfluous developing agent, wherein the superfluous developing agent is in excess of a first set storage capacity;

a second outlet that discharges outside of the housing an excessive developing agent of the developing agent stored in the housing, wherein the excessive developing agent is in excess of a second set storage capacity that is larger in amount than the first set storage capacity;

a container that stores the excessive developing agent discharged from the second outlet; and a detection unit that detects the excessive developing agent stored in the container, and wherein, when detection information from the detection unit of the developing device is received, at least one of or both performances including displaying of warning pertaining to the recovery device and deactivation of operation of the image generator and the recovery device are performed.

* * * * *